US005369804A

United States Patent [19]

Metcalf

[11] Patent Number: 5,369,804

[45] Date of Patent: Dec. 6, 1994

[54] INFANT'S GARMENT WITH SAFETY FEATURE

[76] Inventor: Ronald A. Metcalf, 3475A McCormick Dr., Fort Sheridan, Ill. 60037

[21] Appl. No.: 126,404

[22] Filed: Sep. 27, 1993

[51] Int. Cl.[5] ..... A41D 1/00

[52] U.S. Cl. ..... 2/69; 2/94

[58] Field of Search ..... 2/69, 69.5, 115, 94, 2/93, 85, 311, 102, 111; 224/157, 158; 119/725, 857; 54/37.1, 44, 46, 47, 49; D3/31; 27/28; 297/464, 465, 467, 468; 128/869, 870, 873, 874, 875, 876, 846

[56] References Cited

U.S. PATENT DOCUMENTS

| | | | |
|---|---|---|---|
| 1,808,496 | 6/1931 | Dillon | 128/874 |
| 2,316,602 | 4/1943 | Lee | 2/111 |
| 2,521,175 | 9/1950 | Kruse | 128/874 |
| 3,533,107 | 10/1970 | Baneri | 2/93 |
| 3,896,499 | 7/1075 | Kelly | 2/311 |
| 3,901,229 | 8/1975 | Hensel et al. | 128/874 |
| 4,429,419 | 2/1984 | Snyder | 2/102 |
| 4,449,253 | 5/1984 | Hettinger | 2/93 |
| 4,537,154 | 8/1985 | Kay | 119/857 |
| 5,065,773 | 11/1991 | Jackson et al. | 128/876 |
| 5,193,486 | 3/1993 | Kitchens | 119/96 |

FOREIGN PATENT DOCUMENTS

| | | | |
|---|---|---|---|
| 531708 | 1/1941 | United Kingdom | 27/28 |
| 2184091 | 6/1987 | United Kingdom | 119/725 |

*Primary Examiner*—Clifford D. Crowder
*Assistant Examiner*—Gloria Hale
*Attorney, Agent, or Firm*—Paul H. Gallagher

[57] ABSTRACT

A suit that covers the entire body of the infant. A band is applied to suit, in the front, at about the location of the solar plexus, with handles in the back. An adult can grab the handles with one hand and lift the infant out of danger. The band can be separate from and secured to the suit, or instead, may be part of the suit. Also the band may be continuous or made up of thin, spaced strips.

15 Claims, 2 Drawing Sheets

INFANT'S GARMENT WITH SAFETY FEATURE

BRIEF SUMMARY OF THE INVENTION

This invention relates to an infant's or toddler's garment or suit, incorporating a safety feature enabling quick grasping of the infant to remove him from imminent danger. As used herein, the term him is generic and includes both him and her.

The suit with the safety feature therein may be used on infants of any age, including those in the crawling, beginning walking, and toddling stages.

A principal feature of the invention is to provide a system consisting of any garment that is complete in itself, with the safety feature incorporated therein. More specifically, the infant's garment is made, although including the safety feature, so as to function as an ordinary garment or piece of clothing, for the infant, in normal wear. The safety feature does not in any way interfere with the garment in its character as a complete suit, or in its use on the infant.

Another and more specific object of the invention is to provide such a garment that is adapted to quick and immediate grasping, and further in which the garment in itself is capable of holding the child in a suspended position, upon grasping the garment and lifting the infant. The design is such that the forces involved are exerted in a symmetrical or balanced area of the infant.

A still further feature is to provide such a garment in which the safety feature is made up of readily accessible elements such as a pair of "handles" which are easily grasped by an adult.

Another feature of the garment is that it is comfortable to the infant and from a practical standpoint, not in any way changed from a normal or standard garment.

BRIEF DESCRIPTION OF THE VARIOUS FEATURES OF THE DRAWINGS

Figure 1:
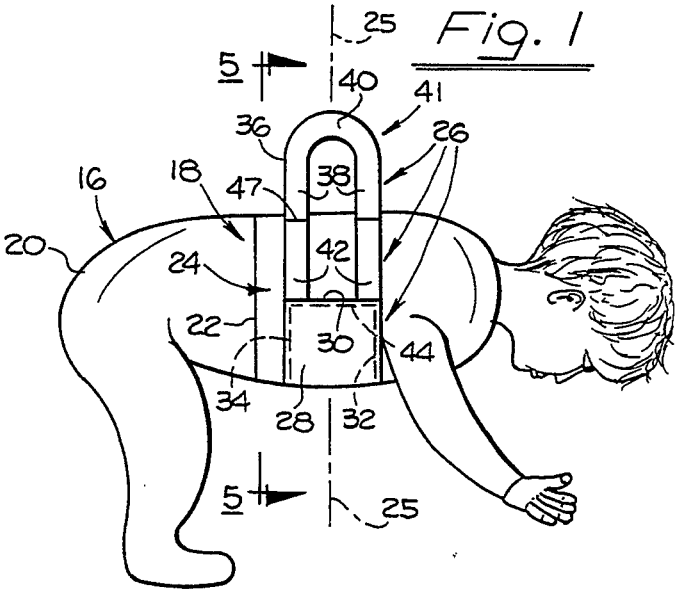
FIG. 1 is a side view of a garment made according to the present invention, applied to an infant.
Figure 2:
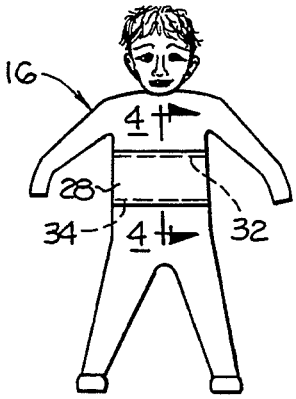
FIG. 2 is a smaller scale view from the front of the garment.

In the drawings, certain of the figures are of semi-diagrammatic nature, to eliminate as much as possible unnecessary details and to facilitate observation thereof.

The garment shown in the drawings is only an example, since the device can De incorporated in any of various forms.

Referring to the drawings in detail, FIG. 1 shows the garment of the invention, identified as 16, applied to an infant. The garment itself, or suit, as observed in FIG. 1, may appear similar to an ordinary infant's garment, and as such, it includes an upper portion 18 constituting a shirt, and a lower portion 20 constituting the trousers. The garment thus covers the entire body of the infant, having a portion covering the torso. In one form of construction, these two parts or pieces may be secured together along a line 22, and thus the garment is a one piece suit. If desired, the suit may cover the feet and even the hands. As applied to the infant, a location is indicated generally at 24, FIG. 1 which is at the sides of the trunk of the body, under the arms. This location and relationship is of significance in describing hereinbelow that portion of the garment that will be lowermost, when the infant is in lifting position, and the infant will be resting on or suspended by that portion of the garment that is then lowermost. FIG. 1 includes a vertical line 25 that extends through or adjacent the solar plexus, or effective center of balance of the infant. The elements of the safety feature are disposed symmetric with this line, and as a consequence the forces involved are exerted against the chest and abdomen.

The suit itself, aside from the safety device, may be made of any desired fabric. In most cases the strength of that fabric is not of significance, because the strength required is incorporated in the safety device, that is, the strength of the material of the safety device is greater than that of the suit. However, in one form, the suit itself is of strong material, as referred to hereinbelow in connection with an alternate form.

The device or component incorporated into the garment, that provides the safety feature of the invention, is indicated in its entirety and broadly at 26 and includes as a principal part thereof, a piece 28 in the form of a band, and in one form of the invention (FIGS. 1–4), the band extends approximately half way around the trunk of the infant, and is located at and extends across the solar plexus indicated at 25 and thereby supports the weight of the infant when the infant is lifted. This band extends preferably about half way around, where its end edges 30 are located in the region 24, i.e. at the sides of the trunk of the body, under the arms. The band 28 is of substantial dimension in width direction of the band, or in the direction of the length or height of the infant, and in a typical case may be 4–5 inches in that direction. This dimension is sufficient to provide support to the mid-section of the infant, and is not intended to be limiting.

In this form of the device (FIGS. 1–4) the band 28 preferably is stitched at both its upper and lower edges to the shirt 18, as indicated at 32, 34. It is so stitched at both edges to prevent entangling of the band with other objects, although it may be so stitched at only one edge (FIG. 4), or not stitched at all, if so desired.

Figure 5:
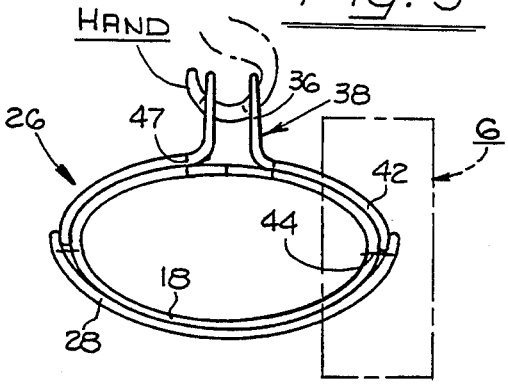
FIG. 5 is a view oriented according to line 5—5 of FIG. 1.
Figure 4:
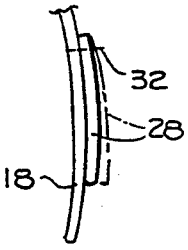
FIG. 4 is a view taken at line 4—4 of FIG. 2.

The safety component 26 includes, in addition to the band 28, a pair of elements 36 referred to as handles, each handle being in the form of a loop, having legs 38 and a cross piece 40 at its outer or extended end 41. The legs 38, at their inner ends 42, are secured to the band 28 as by stitching, as indicated at 44 (FIGS. 1 and 5). If desired, additional securement or stitching 46, as shown in FIG. 6, may be utilized, stitching the band 28 and the handle together with the shirt 18, for additional strength.

Additionally, the handles 36, adjacent their outer or extended ends 41 are secured or stitched at 47 (FIGS. 3, 5) to the shirt 18, at positions adjacent the center of the back of the suit. Thus, the outer terminal portions of the handles (FIG. 3) are detached from the shirt for only a relatively short portion of their length, so as to avoid their dangling and possibly becoming entangled with the infant itself, or possibly with other infants or things.

Figure 6:
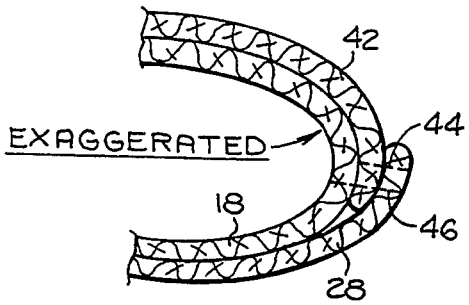
FIG. 6 is a large scale view of the portion included in the rectangle 6 of FIG. 5.
Figure 7:
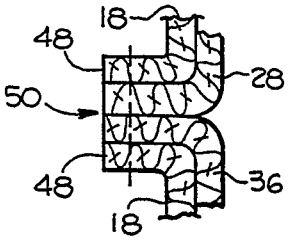
FIG. 7 is a detail of an-alternate construction.

FIG. 7 shows a seam construction that may be utilized instead of either of those shown in FIGS. 5 or 6. In FIG. 7 the shirt 18 has seam elements 48, with the edge elements of the band 28 and handle 36 together incorporated in a seam with the elements 48, as indicated at 50, providing additional strength.

While the material of the suit proper may be of any desired kind, independent of unusual strength, as noted, the parts of the safety component of the present invention, namely the band 28 and handles 36, are preferably made of unusually strong fabric so as to withstand the greater forces encountered.

Figure 3:
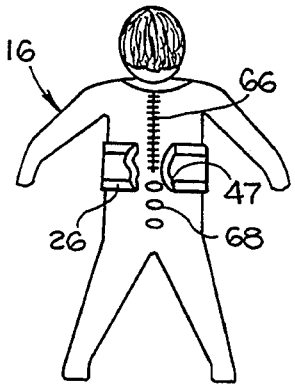
FIG. 3 is a view from the rear.

In the use of the device, the suit 16 is applied to the infant in an ordinary way, with no special attention given to the safety features. In such a situation, as represented in FIG. 3, the outer end portions of the handles 26 beyond the stitching 47, are relatively short, and do not in any way interfere with applying the suit, or removing it, or in connection with the activities of the infant.

The primary advantage of the device is now pointed up, namely, if the infant is in a position of immediate danger, an adult can quickly grasp the handles and single-handedly lift the infant and carry it away from the dangerous spot. This can be done what may be considered instantaneously, avoiding any excessive time for grasping the child with both hands, for example, and not removing it from the dangerous location as quickly as with the use of the present device.

Figure 8:
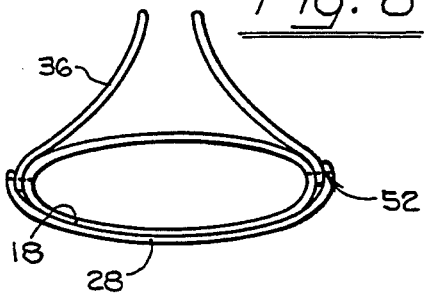
FIG. 8 is a view oriented according to FIG. 5 showing an alternate form.

Attention is directed to a modified form, illustrated in FIG. 8, which is different from that described above. In the present form (FIG. 8), the handles 36 are not secured near their outer ends to the shirt as shown at 46 in FIG. 5, but are secured thereto only at the side portions of the garment, indicated at 52 by a stitching construction utilized in any of FIGS. 5, 6, 7. In the present case, FIG. 8, the lifting force is transmitted from the handles directly to the end edges of the band 28, and from the band to the body of the infant.

Figure 9:
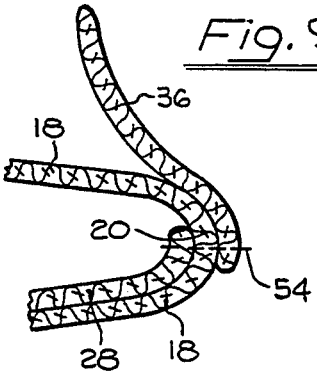
FIG. 9 shows still another form, and is the equivalent of a large scale view of the right hand portion of FIG. 8.

FIG. 9 shows a slightly modified arrangement wherein the band 28 is placed on the inner surface of the shirt 18, rather than on the outer surface as described above, and the end edges of the band, and the inner end edges of the handles, are stitched together with the shirt 18, as in common stitching 54.

Figure 10:
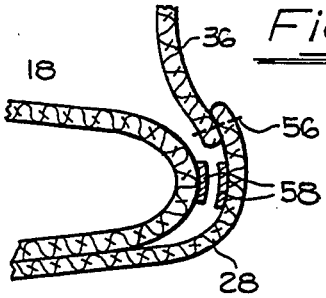
FIG. 10 is a view similar to FIG. 9 showing a modified form.
Figure 11:
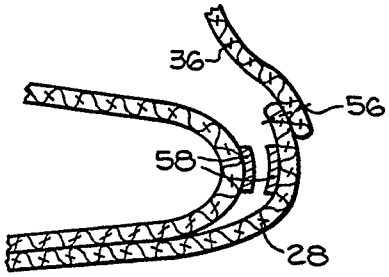
FIG. 11 is a view similar to FIG. 10 showing another, slightly modified, form.

Still another modified form is illustrated in FIGS. 10 and 11. In these figures, the safety device or component is shown as a separate component from the suit proper, and may be applied to and removed from the suit as desired. A representative form of construction for producing this result is shown, where the handles 36 are secured to the band 28 as indicated at 56, which may be ordinary stitching. The band 28 and separate shirt 18 each has a connector piece 58, of known hook/filament construction, which when fitted together normally hold the band in place on the shirt.

FIG. 11 shows a form slightly modified relative to that of FIG. 10. In FIG. 10 the handle 36 is secured to the inner surface of the band, while in FIG. 11 the handle is secured to the outer surface of the band, by a similar stitching 56. The same hook/filament connector pieces 58 are utilized. In the present case, FIG. 11, the tension forces of the handle may produce additional pressure forcing the end edges of the band inwardly toward the body.

In the case of the constructions of FIGS. 10 and 11, in the interpretation of the claims, the band when attached to the shirt, is to be considered incorporated in the shirt. In this case also, the band may be provided with holes such as the holes 64 in FIG. 12, and for the same purpose, as referred to below.

Figure 12:
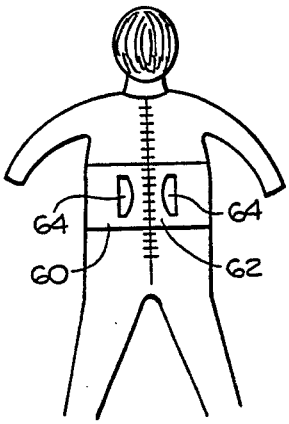
FIG. 12 is a view similar to FIG. 3 showing the rear of the suit, and including a modified form.

The invention is considered in its broad aspects to cover a construction in FIG. 12. In this case a band 60 substantially encircles the body, instead of terminating at the sides of the body, under the arms. In this case what may be considered the rear ends of the band, 62, may be adjacent each other at the middle of the back. The band, at its rear end portions, is provided with holes 64, which also extend through the shirt, forming gripping holes. In this case, the adult, in grasping the child, so grasps it by grabbing the band at the portion between the holes, and lifts the infant in that manner.

The holes 64, and the end edge portions 62 of the band together may be considered the equivalent to the outer ends of the handles 36 in the previous forms, this being particularly significant in interpretation of the claims. Also in interpretation of the claims, it may be considered that the front portion of the band 60 engaging the body of the infant, and opposite that shown in FIG. 12 constitutes the band, and the entire rear portion, which includes the holes 64 and end portions 62 be considered the handles.

In applying the safety device to an infant's suit the original suit to which it is applied, is preferably of one-piece construction at the front, i.e. without openings, and the back can be opened, being provided for example with a zipper 66 (FIG. 3) or buttons 68. As will be understood, this arrangement assures that an openable structure will not be in a location for the lifting forces to be applied thereto and consequently fail.

Figure 13:
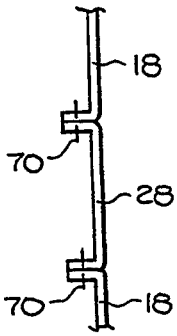
FIG. 13 is a detail of another modified construction.

It is also within the broad scope of the invention, that the band 28 be incorporated into the shirt (FIG. 13) as an integral and continuous part thereof, rather than as a separate piece. In such construction, the edges of the band are secured, at 70, to corresponding edges of the upper and lower parts of the shirt, the resulting construction forming a single-thickness shirt.

Figure 14:
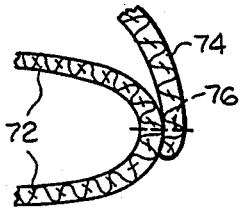
FIG. 14 is a view similar to FIG. 6, of an alternate form.

Still another alternate form is represented in FIG. 14, which is oriented according to FIG. 6. In this case the suit itself, here indicated 72, may be made of strong material such as denim, and the handles 74, separate items and similar to the handles 36, stitched directly to the material as at 76, at the sides.

Figure 15:
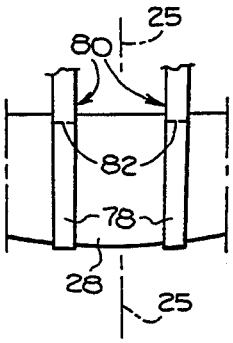
FIG. 15 is a view oriented according to the middle portion of FIG. 1, showing still another form.

Still further, the invention includes another alternate form, as shown in FIG. 15, which is oriented according to the central portion of FIG. 1. In this case, instead of a band 28 of substantial width, separate continuous strips 78 are located at positions adjacent the upper and lower edges of a band that would be used, and extended across the front and to the rear, forming handles 80. The strips are secured to the suit itself at 82, in any of the ways described above. The portions of the strips across the front are the equivalent of a band and are to be included generically under that term.

I claim:

1. An infant's garment comprising, a suit covering the entire body including torso, trunk, leg and arm covering portions, a band incorporated in the torso portion positioned for engaging the front of the body of the infant and extending transversely therealong at least to positions at the sides under the arms, said band being at least 4–5 inches in width in direction of the height of the infant and being located substantially at the solar plexus of the infant, thereby providing great support for lifting, and handles secured to the band at positions under the arms and extending to the rear capable of being grasped by the hand of an adult and lifted single handedly, the resulting lifting action thereof acting through the band to lift the infant, the force of the lifting action being exerted on and transmitted through the band to the front of the body of the infant, that force being so transmitted essentially entirely to the band to the exclusion of other portions of the garment, the handles constituting the sole means for grasping the garment single handedly by the adult.

2. An infant's garment according to claim 1 wherein, the band is of material stronger than that of the remainder of the garment.

3. An infant's garment according to claim 2 wherein, the band is separate from the remainder of the garment and secured thereto on the outer surface thereof.

4. An infant's garment according to claim 3 wherein, the band is secured to the remainder of the garment along the top and bottom edges of the band.

5. An infant's garment according to claim 3 wherein, the band is secured to the remainder of the garment at only one of the top or bottom edges of the band.

6. An infant's garment according to claim 2 wherein, the band is separate from the remainder of the garment and secured thereto on the inner surface of the latter.

7. An infant's garment according to claim 1 wherein, the handles are also secured to the shirt at positions near the middle of the back of the shirt.

8. An infant's garment according to claim 7 wherein, the handles have inner ends secured to the band and outer ends remote therefrom, the positions of securement of the handles to the shirt are near but spaced from the outer ends of the handles, and the extremities of the handles at their remote ends are in the form of loops adapted for grasping thereof by an adult.

9. An infant's garment according to claim 1 wherein, the band and handles together constitute a component separate from the shirt, and the garment includes means for detachably securing that component to the shirt.

10. An infant's garment according to claim 9 wherein, the means for so securing the component includes interacting hook/filament pads secured respectively to the component and shirt.

11. An infant's garment comprising, a suit covering the entire body of the infant including torso, trunk, leg and arm covering portions, the torso portion including a segment constituting a band surrounding the infant, including a back portion, the back portion including holes adjacent the center of back, but spaced apart, and the portions of the back portion and the holes together constituting handle means for grasping by an adult for lifting the infant.

said band being at least 4–5 inches in width in direction of the height of the infant and being located substantially at the solar plexus of the infant, thereby providing great support for lifting.

12. An infant's garment according to claim 1 wherein, the band forms a portion of the shirt, in a continuous single-thickness construction.

13. An infant's garment according to claim 12 wherein, the band encircles the body of the infant and has spaced apart hand gripping holes adjacent the middle of the back of the infant.

14. An infant garment according to claim 1 wherein, the entire garment is composed as a single thickness of strong material, the band is constituted by a portion of the shirt and thus being continuous as a single thickness with the remainder of the shirt, and the handles are separate from the shirt and secured to the shirt at positions under the arms, and free of detachment with the shirt at the front.

15. An infant's garment according to claim 1 wherein, the band and handles are constituted by a pair of strips, spaced apart along the height of the infant, and extending across the front and extending to the rear, and secured to the shirt.

* * * * *